US008651624B2

(12) United States Patent
Pan et al.

(10) Patent No.: US 8,651,624 B2
(45) Date of Patent: Feb. 18, 2014

(54) FLUID EJECTOR STRUCTURE

(75) Inventors: Alfred I-Tsung Pan, Sunnyvale, CA (US); Erik D. Torniainen, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 385 days.

(21) Appl. No.: 13/063,438

(22) PCT Filed: Oct. 14, 2008

(86) PCT No.: PCT/US2008/079842

§ 371 (c)(1), (2), (4) Date: Mar. 10, 2011

(87) PCT Pub. No.: WO2010/044775

PCT Pub. Date: Apr. 22, 2010

(65) Prior Publication Data

US 2011/0205303 A1 Aug. 25, 2011

(51) Int. Cl.
*B41J 2/05* (2006.01)
*B41J 2/04* (2006.01)

(52) U.S. Cl.
USPC ..... 347/65; 347/54

(58) Field of Classification Search
None
See application file for complete search history.

(56) References Cited

U.S. PATENT DOCUMENTS

| | | | | |
|---|---|---|---|---|
| 4,894,664 | A | 1/1990 | Pan | |
| 6,003,977 | A | 12/1999 | Weber | |
| 6,019,907 | A * | 2/2000 | Kawamura | 216/27 |
| 6,113,221 | A | 9/2000 | Weber | |
| 6,561,631 | B2 | 5/2003 | Shin | |
| 6,938,340 | B2 | 9/2005 | Haluzak | |
| 6,974,548 | B2 * | 12/2005 | Giere et al. | 216/27 |
| 7,070,262 | B2 | 7/2006 | Yamamoto | |
| 7,338,580 | B2 * | 3/2008 | Conta et al. | 204/224 M |
| 2002/0008732 | A1 | 1/2002 | Moon | |
| 2003/0081072 | A1 * | 5/2003 | Trueba | 347/63 |

FOREIGN PATENT DOCUMENTS

| | | |
|---|---|---|
| JP | 07-195697 | 8/1995 |
| JP | 2004-230811 | 8/2004 |
| KR | 10-2002-0026076 | 4/2002 |
| KR | 10-0408269 | 12/2003 |

* cited by examiner

*Primary Examiner* — Geoffrey Mruk

(57) ABSTRACT

In one embodiment, a fluid ejector structure includes: a chamber; a bridge spanning at least part of the chamber; a channel through which fluid may enter the chamber; a fluid ejector element on the bridge; and an outlet through which fluid may be ejected from the chamber at the urging of the fluid ejector element. The outlet is disposed opposite the fluid ejector element across a depth of the chamber and the chamber, ejector element and outlet are configured with respect to one another such that substantially all of the fluid in the chamber is ejected through the outlet upon actuation of the ejector element.

13 Claims, 11 Drawing Sheets

FLUID EJECTOR STRUCTURE

BACKGROUND

Thermal inkjet printers typically utilize a printhead that includes an array of orifices (also sometimes called nozzles) through which ink is ejected on to paper or other print media. Ink filled channels feed ink to a firing chamber at each orifice. As a signal is applied individually to addressable thermal elements, resistors for example, ink within a firing chamber is heated, causing the ink to bubble and thus expel ink from the chamber out through the orifice. As ink is expelled, more ink fills the chamber through a channel from the reservoir, allowing for repetition of the ink expulsion sequence. The use of thermal inkjet printing in high throughput commercial applications presents special challenges for maintaining good print quality.

Small droplets released during break-up of the tail of more elongated ink drops ejected by conventional inkjet printheads typically travel more slowly to the print medium than does the main drop (the head of the ejected ink drop). Thus, these trailing, "satellite" droplets land on the print medium away from the main drop, forming extraneous marks along the edges or in the background of the desired images. Such print quality defects often make the images appear fuzzy or smeared. This undesirable characteristic of ejecting elongated ink drops may become more pronounced as printing speed increases and the printhead and print medium move faster and faster with respect to one another.

Clear mode printing, in which substantially all of the ink in the firing chamber is ejected, has been used to eject tail free drops. However, the rate at which ink refills the firing chamber after each ejection in preparation for the next ejection is significantly slower than for printing with elongated ink drops. In "normal", non-clear mode printing, the collapsing ink bubble tends to drag ink into the firing chamber to help speed refill. In clear mode printing, since the ink bubble is vented completely out through the orifice, there is no collapsing bubble to help draw in refill ink, thus slowing refill. Consequently, conventional clear mode printhead architectures have not proven suitable for inkjet web printing presses and other high speed printing applications.

DRAWINGS

Figure 2:
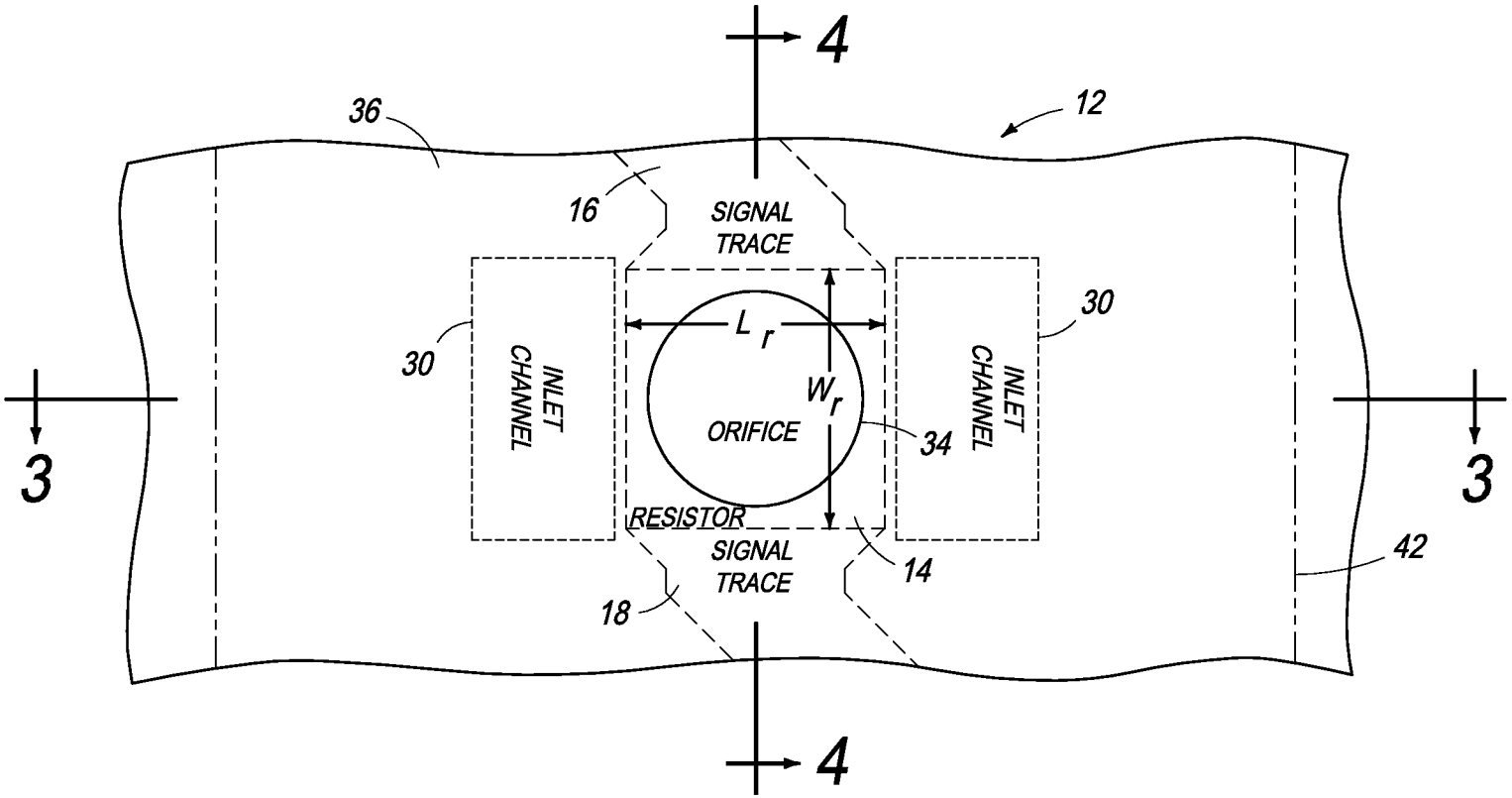
FIG. 2 is a plan view of an individual ejector structure embodiment from the printhead structure of FIG. 1.
Figure 3:
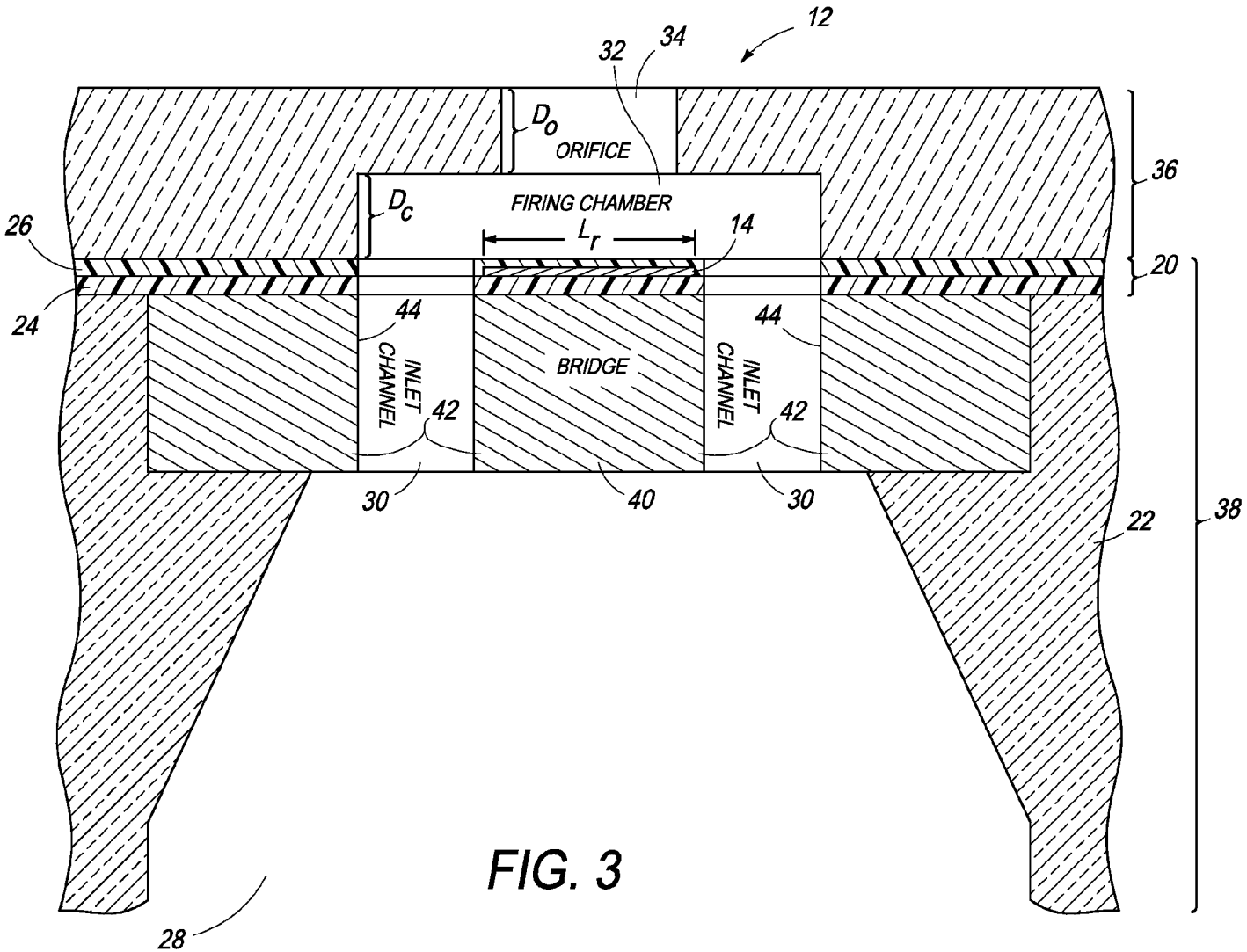
Figure 4:
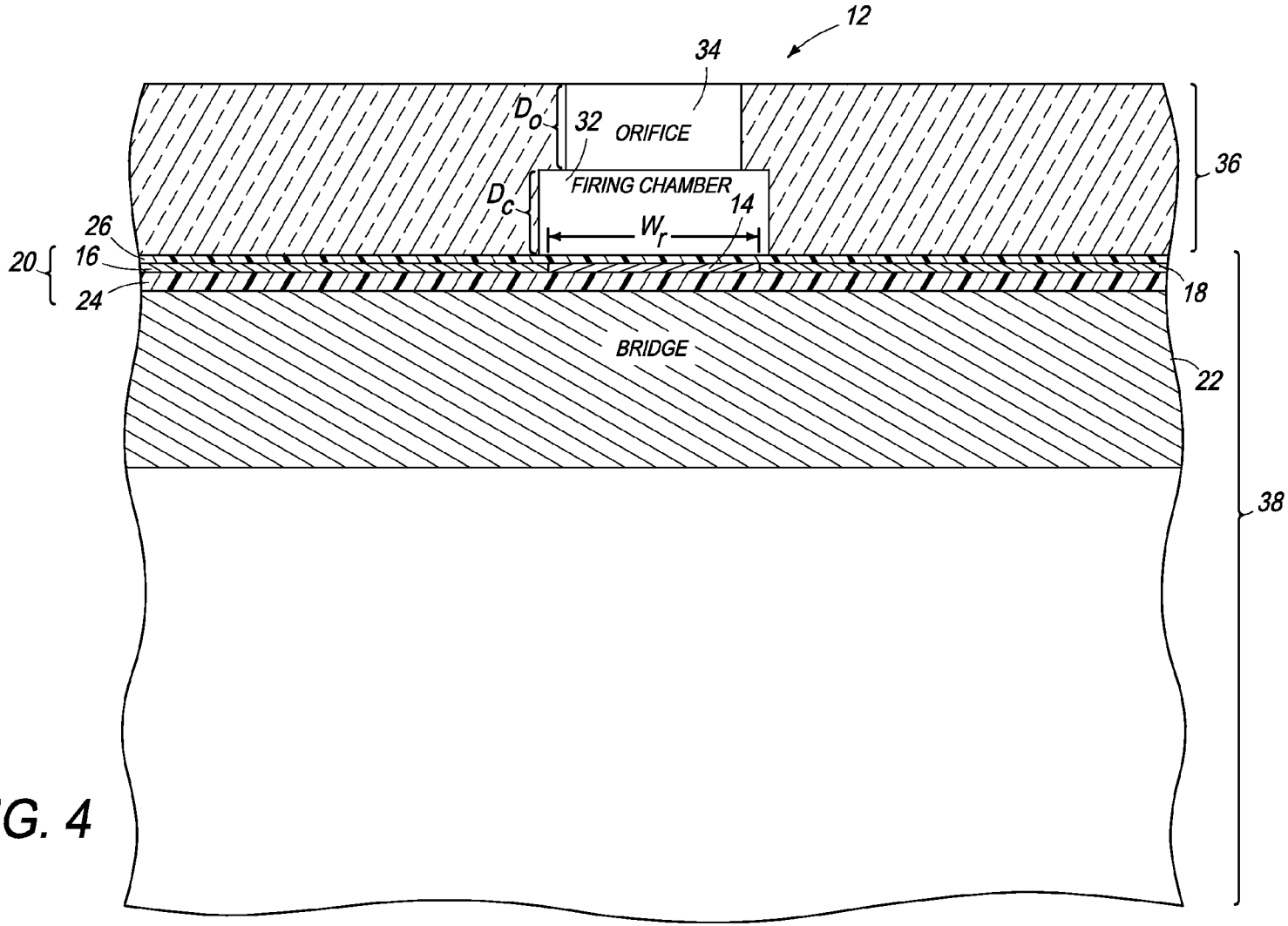

FIGS. 3 and 4 are section views of the ejector structure embodiment of FIG. 2 taken along the lines 3-3 and 4-4, respectively, in FIG. 2.

Figure 5:
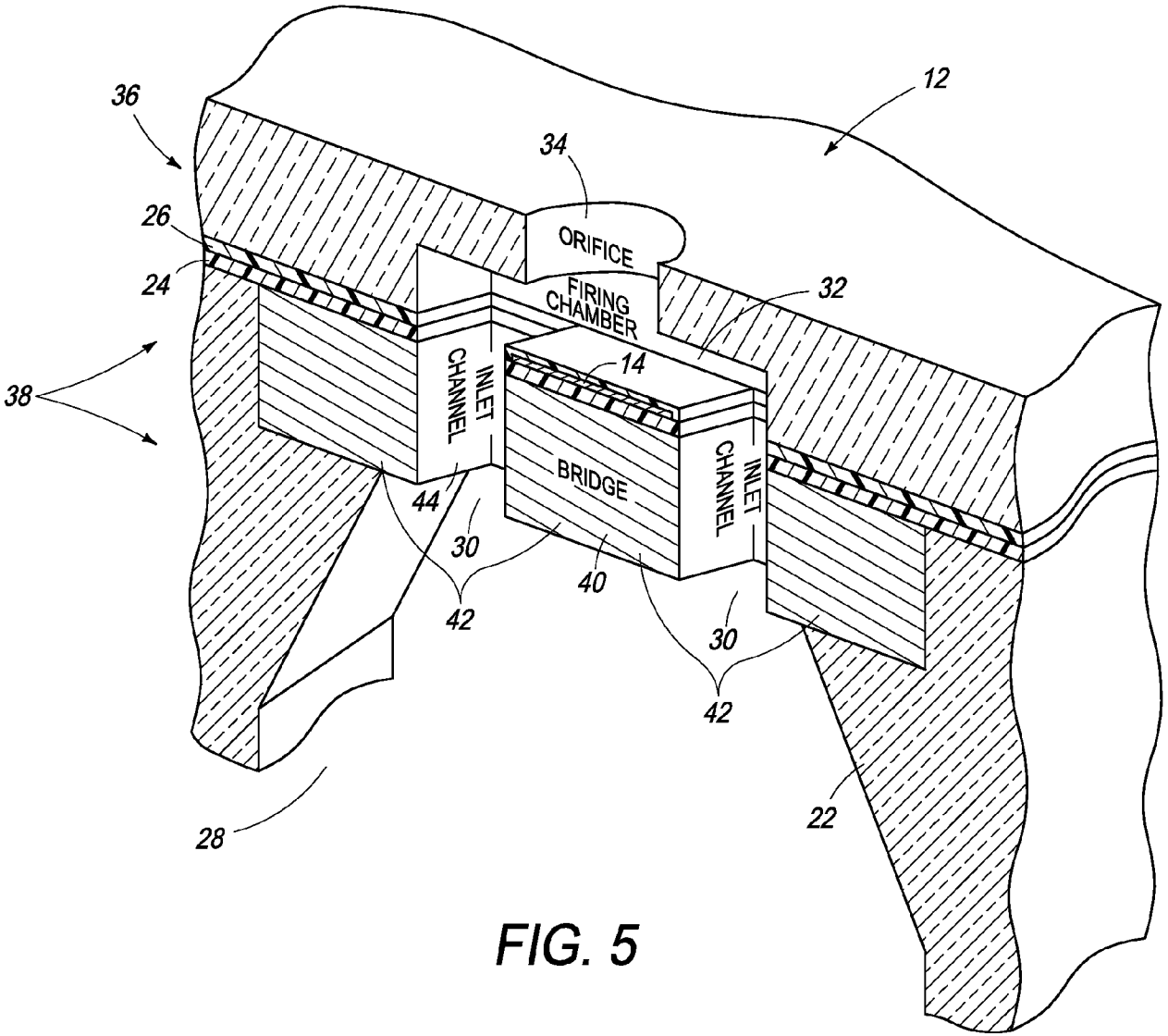

FIG. 5 is a perspective section view of the ejector structure embodiment of FIG. 2 corresponding to section line 3-3 in FIG. 2.

Figure 6:
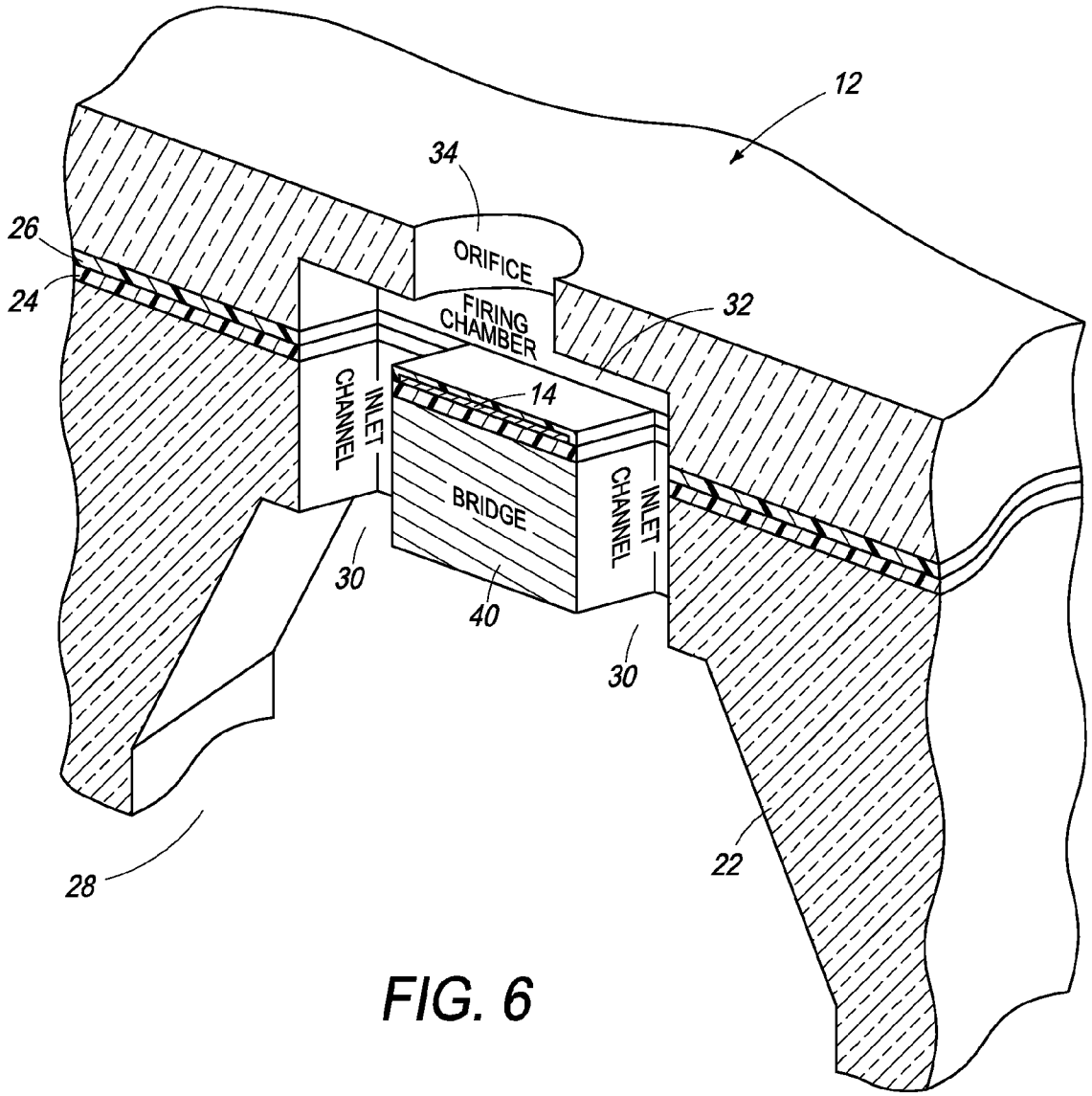

FIG. 6 is a perspective section view of an ejector structure according to another embodiment of the disclosure in which the bridge part is configured as a more narrow strip extending through only a center portion of the firing chamber.

Figure 7:
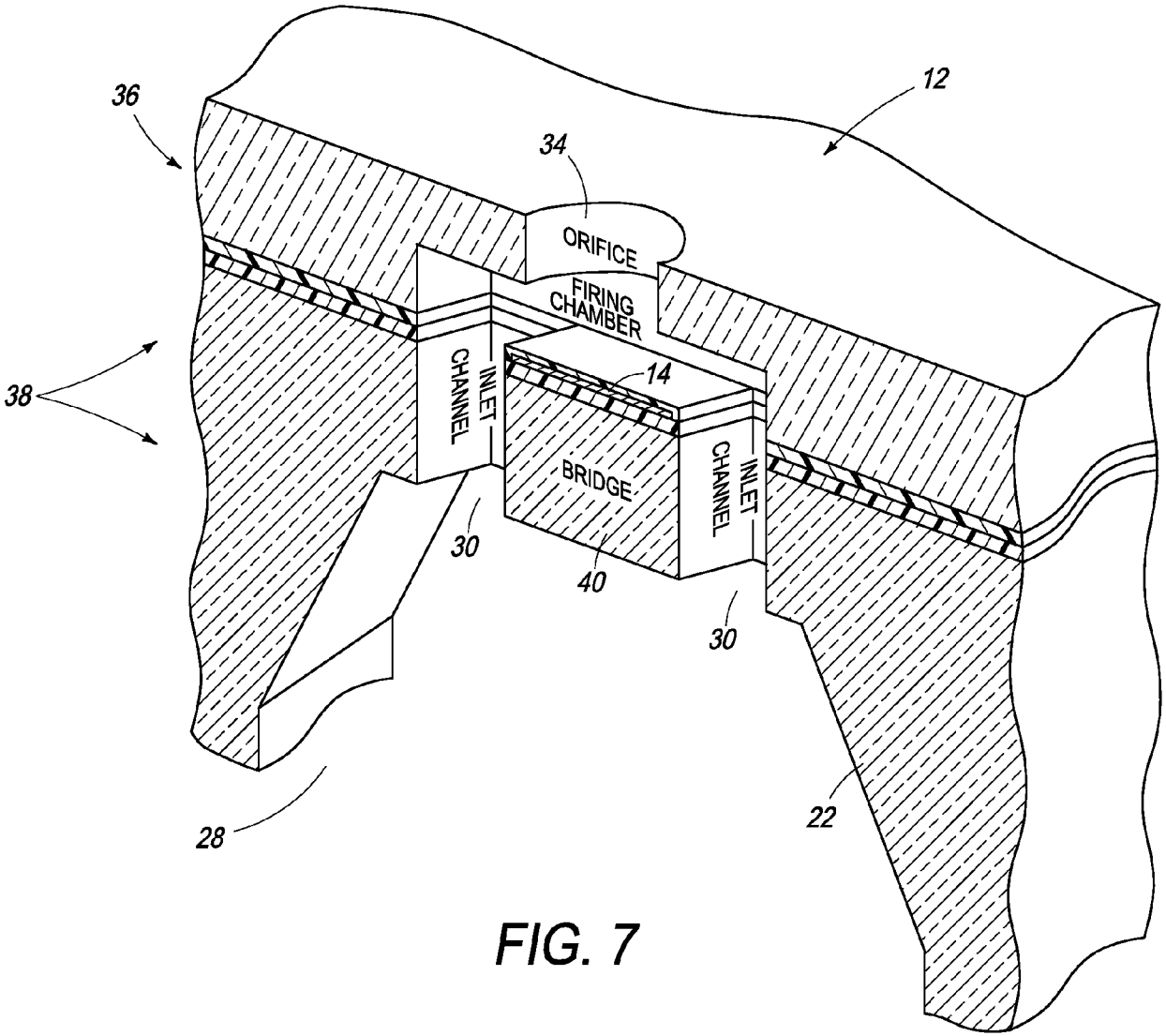

FIG. 7 is a perspective section view of an ejector structure according to another embodiment of the disclosure in which the bridge part is integral to the substrate.

Figure 8:
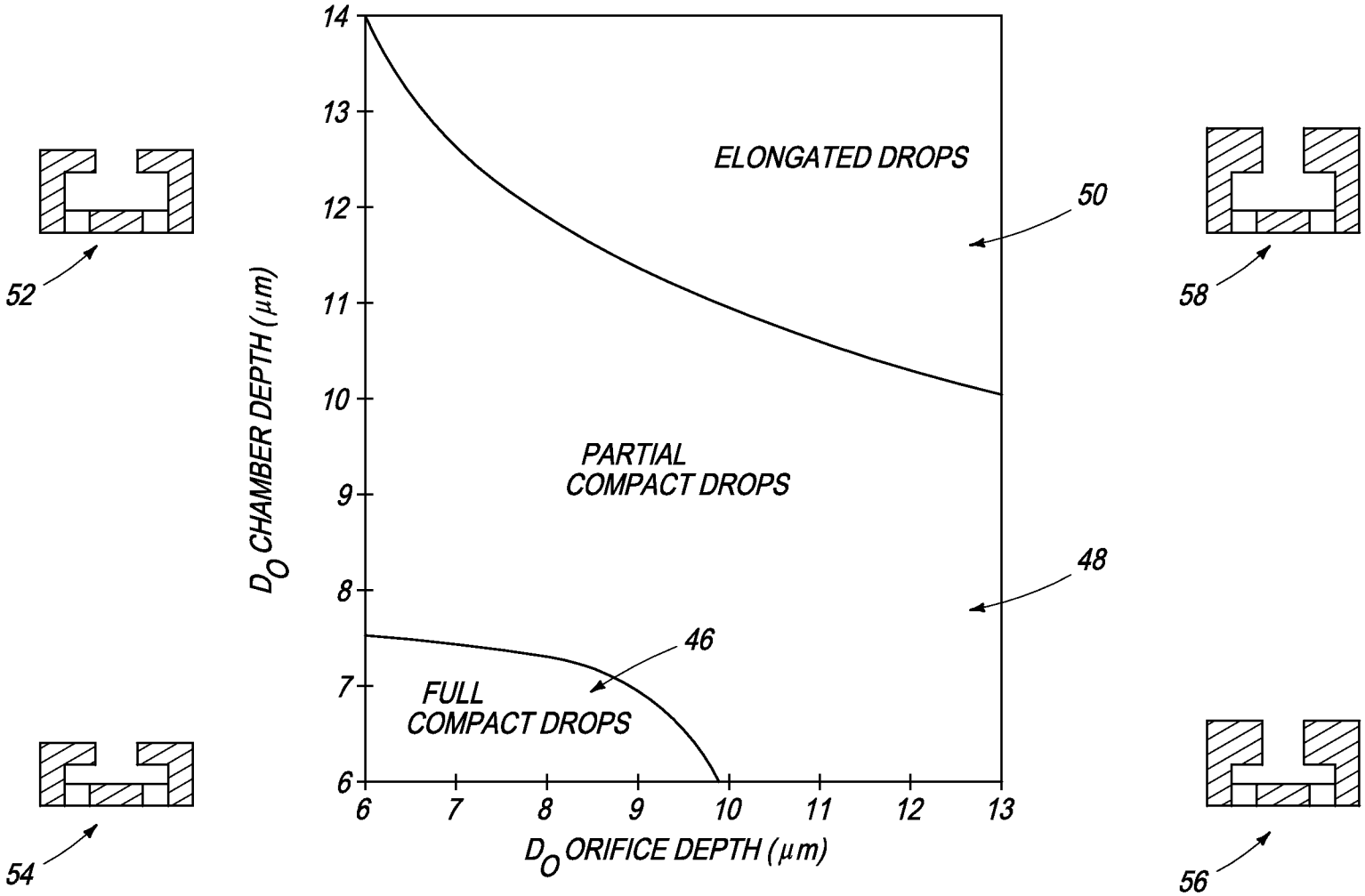

FIG. 8 is a graph illustrating clear mode and non-clear mode printing embodiments.

Figure 9:
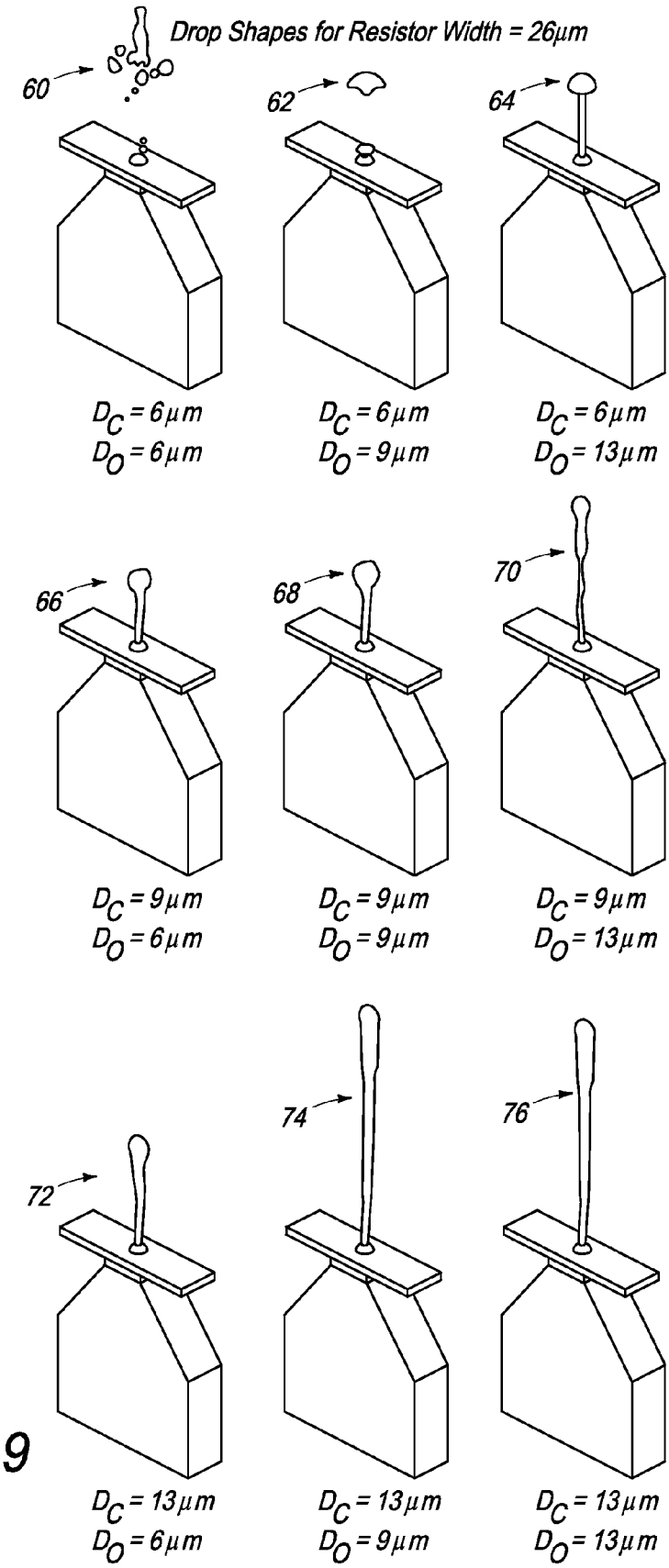
Figure 10:
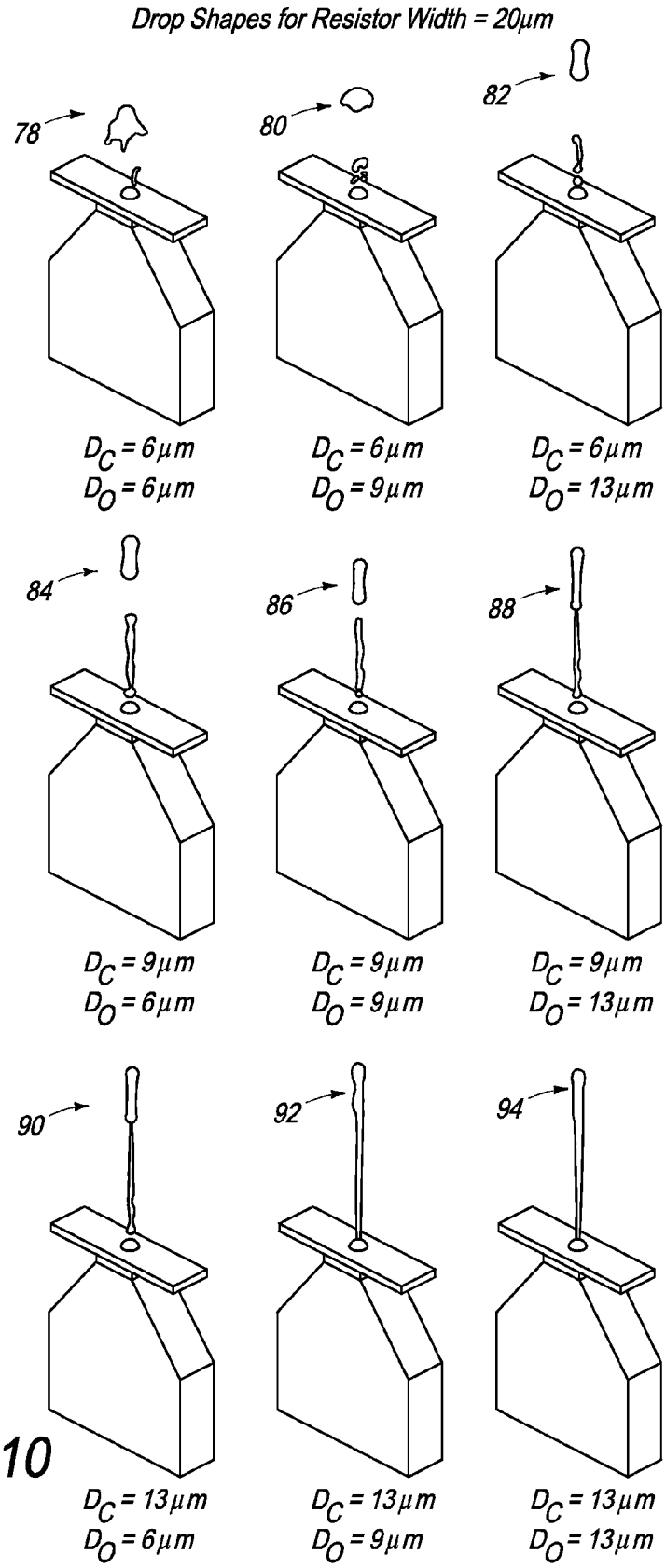
Figure 11:
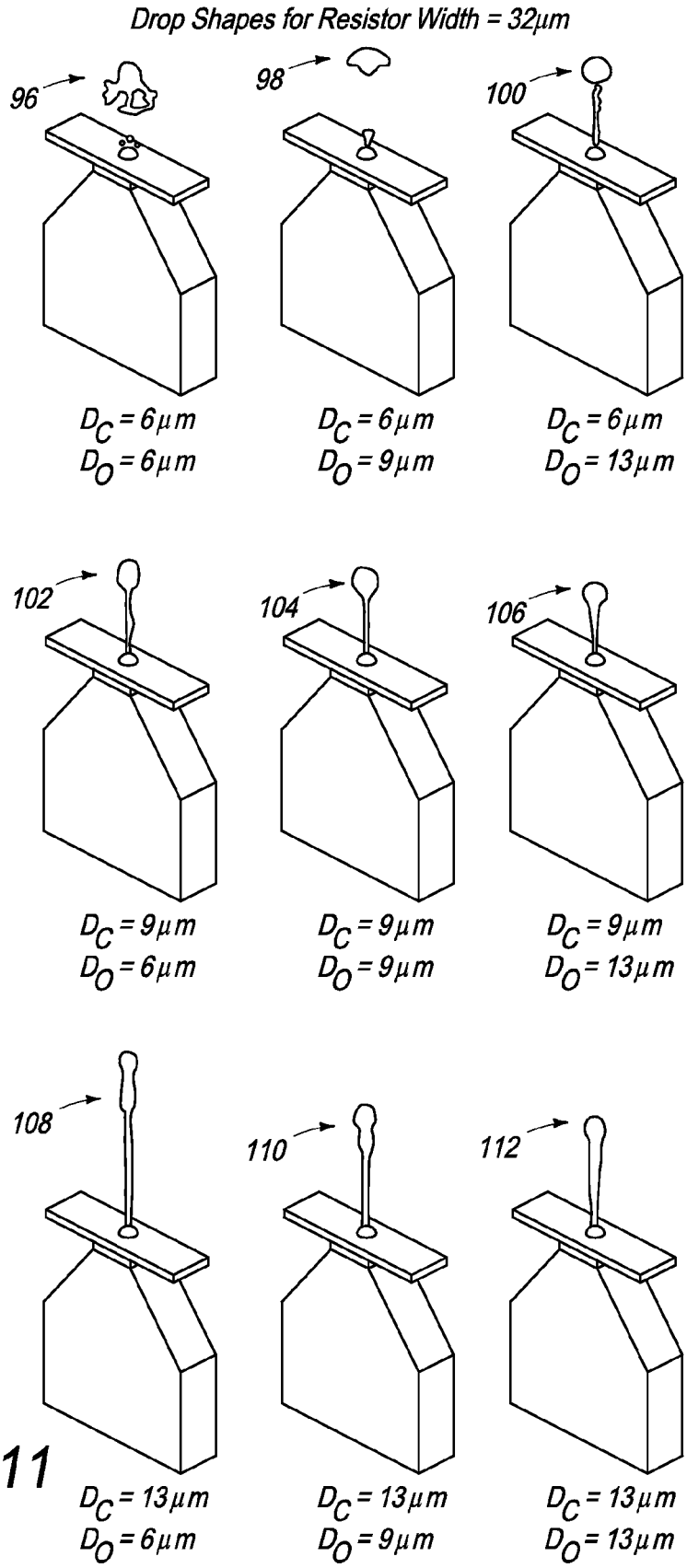

FIGS. 9-11 illustrate drop shapes for different printhead embodiments.

The structures shown in the figures, which are not to scale, are presented in an illustrative manner to help show pertinent features of the disclosure

DESCRIPTION

Embodiments of the present disclosure were developed in an effort to improve print quality and firing resistor reliability for high throughput commercial inkjet printing applications. It has been discovered that combining firing chamber configurations typical of those used in clear mode printing with a bridge type, dual feed channel printhead architecture allows for ejecting compact, substantially tail free ink drops at frequencies needed to support inkjet web printing presses and other high speed printing applications. Embodiments of the disclosure will be described with reference to a thermal inkjet printhead structure. Embodiments, however, are not limited to thermal inkjet printhead structures, or even inkjet printhead structures in general, but may include other fluid ejector structures. Hence, the following description should not be construed to limit the scope of the disclosure.

Figure 1:
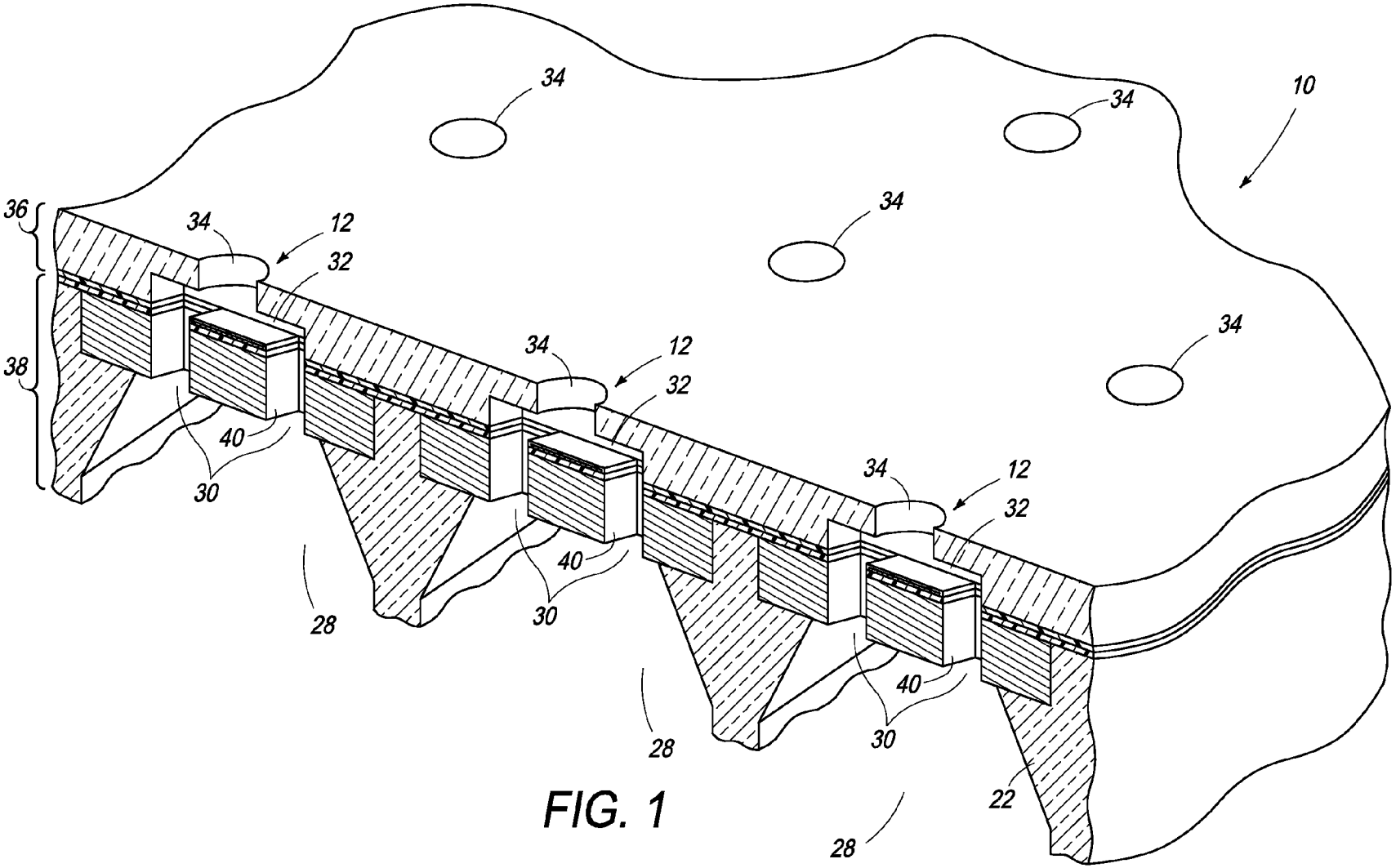
FIG. 1 is a perspective section view illustrating a thermal inkjet printhead structure according to one embodiment of the disclosure.

FIG. 1 is a perspective section view illustrating a thermal inkjet printhead structure 10 according to one embodiment of the disclosure. Printhead structure 10 represents more generally a fluid-jet precision dispensing device or fluid ejector structure for precisely dispensing a fluid, such as ink, as described in more detail below. Printhead structure 10 includes an array of individual ejector structures 12 each configured to eject drops of ink or other fluid. FIGS. 2-5 illustrate an individual ejector structure 12 from FIG. 1. FIG. 2 is a plan view of ejector structure 12. FIGS. 3 and 4 are section views of ejector structure 12 taken along the lines 3-3 and 4-4, respectively, in FIG. 2. FIG. 5 is a perspective section view of ejector structure 12 corresponding to section line 3-3 in FIG. 2. Conventional techniques well known to those skilled in the art of printhead fabrication and semiconductor processing may be used to form the structures described below.

While thermal inkjet printing devices designed to eject ink onto media are described, those of ordinary skill within the art can appreciate that embodiments of the present disclosure are not so limited. In general, embodiments of the present disclosure may pertain to any type of fluid-jet precision dispensing device or ejector structure for dispensing a substantially liquid fluid. A fluid-jet precision dispensing device is a drop-on-demand device in which printing, or dispensing, of the substantially liquid fluid in question is achieved by precisely printing or dispensing in accurately specified locations, with or without making a particular image on that which is being printed or dispensed on. As such, a fluid-jet precision dispensing device is in comparison to a continuous precision dispensing device, in which a substantially liquid fluid is continuously dispensed. An example of a continuous precision dispensing device is a continuous inkjet printing device. The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, and fuel which are not substantially or primarily composed of gases such as air and other types of gases. Therefore, while the following description is described in relation to an inkjet printhead structure for ejecting ink onto media, embodiments of the present disclosure more generally may pertain to any type of fluid-jet precision dispensing device or fluid ejector structure for dispensing a substantially liquid fluid.

Referring now to FIGS. 1-5, firing resistors 14 and signal traces 16, 18 (FIGS. 2 and 4) in ejector structure 12 are formed as part of a thin film stack 20 on a substrate 22. Signal traces 16 and 18 carry electrical firing signals to selectively actuate or "fire" a corresponding resistor 14 as directed by the printer controller during printing operations. Although a silicon substrate 22 is typical, other suitable substrate materials could be used. In addition to firing resistors 14 and traces 16, 18, thin-film stack 20 usually also will include layers/films that electrically insulate resistor 14 from surrounding structures, provide conductive paths to resistors 14 (including traces 16 and 18), and help protect against contamination, corrosion and wear (such protection is often referred to as passivation). In the embodiment shown in FIGS. 1-5, film stack 20 includes an oxide layer 24 on substrate 22 and a passivation dielectric layer 26 over resistors 14 and traces 16, 18. The specific composition and configuration of film stack 20, however, are not important to the innovative aspects of this disclosure except with regard to the configuration of resistors 14 described below.

Passages 28 in substrate 22 carry ink to ink inlet channels 30 that extend through film stack 20 near resistors 18. Ink enters a firing chamber 32 associated with each firing resistor 18 through a corresponding pair of channels 30. Ink drops are expelled or "fired" from each chamber 32 through an orifice 34. Orifices 34 are formed in an orifice sub-structure 36 made of silicon or other suitable material formed on or bonded to the underlying ejector element sub-structure 38. Orifice sub-structure 36 is sometimes referred to as an orifice plate. A dielectric or other suitable passivation layer (not shown) may be formed on those areas of orifice sub-structure 36 exposed to ink to inhibit corrosion from prolonged exposure to the ink, for example at firing chambers 32 and orifices 34. The specific composition and configuration of orifice sub-structure 36, however, are not important to the innovative aspects of this disclosure except with regard to the configuration of firing chambers 32 and orifices 34 described below.

Each resistor 14 is supported on a bridge 40 that at least partially spans firing chamber 32. The span of bridge 40 is defined by a pair of ink inlet channels 30 positioned opposite one another across chamber 32 as best seen in FIG. 2. Bridge 40 may made from a metal or other suitable high thermal conductivity part 42 embedded in substrate 22, as shown in FIG. 1-5, to facilitate cooling. In the embodiment shown in FIGS. 1-5, inlet channels 30 are formed fully within a bridge part 42 that surrounds firing chamber 32. In an alternative embodiment shown in FIG. 6, bridge part 42 is configured as a more narrow strip extending through only a center portion of firing chamber 32 such that the outboard part 44 of each inlet channel 30 is formed in substrate 22. In an alternative embodiment shown in FIG. 7, bridge part 42 is integral to substrate 22. The specific material for and configuration of bridge 40 and bridge part 44 may be varied as desirable for a particular printhead application. For example, the added cost of a metal bridge 40 may be desirable for some printing applications or fabrication process flows while a silicon bridge 40 integral to substrate 22 may be desirable for other printing applications or fabrication process flows.

Referring again to FIGS. 1-5, the relative sizes of resistor 14, firing chamber 32 and orifice plate 36 may be configured to control the shape of ink drops ejected through orifice 34. There is a region of dimensions within firing chamber 32 that can deliver compact, substantially tail free ink drops with no or few satellite drops trailing the main drop and still maintain refill rates for high speed printing, firing frequencies of 30 kHz for example. As used in this document, a "compact" drop means a drop in which 80% or more of the mass of each drop, on average, is contained in the main drop and, correspondingly, 20% or less of the mass of the drop is contained in a tail and/or in satellite droplets, (in conventional inkjet printing, by contrast, typically only about 50% of the mass of the drop is contained in the main drop.) Compact drop printing may be achieved where the sum of the depth of firing chamber 32 plus the depth of orifice 34 approximates the height of the ink bubble formed upon actuation of resistor 14 such that substantially all of the ink is ejected from firing chamber 32 through orifice 34. In a typical printing operation, for example, the ink bubble expands to about 20 μm in height but may be up to 30 μm high. Therefore, it is expected that the combined depth of chamber 32 and orifice 34 will not be greater than 30 μm for a typical implementation of ejector structure 12. Approximate in this context means the combined depth of chamber 32 and orifice 34 is such that the bubble height exceeds the depth of chamber 32 without necessarily extending to the full depth of orifice 34. For some implementations ejecting compact drops it may be desirable that the combined depth of chamber 32 and orifice 34 is such that the bubble height only slightly exceeds the depth of chamber 32, allowing the bubble to push just into orifice 34, while in other implementations the bubble height should approach the full depth of orifice 34, allowing the bubble to push through to (or close to) the exterior of orifice 34.

The dimensions of one example configuration for compact drop printing are noted below with reference to FIGS. 2-4 for a rectangular firing chamber 32 51 μm long ($L_c$=51 μm) and 33 μm wide ($W_c$=33 μm) and a circular orifice 34 18 μm in diameter, $L_r$ Length of resistor 14=26 μm
$W_r$ Width of resistor 14=26 μm
$D_c$ Depth of chamber 32=6 μm
$D_o$ Depth of orifice 34=9 μm Increasing chamber depth $D_c$ to 9 μm will produce satellite droplets but still within the range of clear mode printing. However, increasing chamber depth $D_c$ to 13 μm will result in non-clear mode printing. Similarly, increasing orifice depth $D_o$ will also affect the shape of the drop ejected from chamber 32.

The effect of different chamber depths $D_c$ and orifice depths $D_o$ on drop shape is illustrated in the graph of FIG. 8 for a 51 μm long, 33 μm wide rectangular firing chamber 32. Referring to FIG. 8, an area 46 of satellite free "full" compact drop printing appears in the lower left hand part of the graph bounded by a chamber depth $D_c$ of about 7.5 μm along the vertical axis and an orifice depth $D_o$ of about 9.5 μm along the horizontal axis. An area 48 of "partial" compact drop printing heavily weighted to the main drop appears in the middle of the graph bounded along the upper end by a chamber depth $D_c$ of about 14 μm at a an orifice depth $D_o$ of 6 μm down to about 10.5 μm at an orifice depth $D_o$ of 13 μm. Elongated drop printing area 50 occurs at chamber depths $D_c$ greater than about 14 μm at a an orifice depth $D_o$ of 6 μm and greater than about 10.5 μm at an orifice depth $D_o$ of 13 μm. The different depths $D_c$ and $D_o$ and the corresponding changes in the configuration of firing chamber 32 near each of the four corners of the graph are depicted structurally by small generalized representations of ejector structure 12 designated by part numbers 52, 54, 56 and 58 in FIG. 8.

Ink drop shapes corresponding to some of the data points on the graph of FIG. 8 are illustrated in FIG. 9. Referring to FIG. 9, for a chamber depth $D_o$ of 6 μm, satellite free full compact ink drops 60 and 62 are ejected for orifice depths $D_o$ of 6 μm and 9 μm and a partial compact drop 64 heavily weighted to the main drop is ejected for an orifice depth $D_o$ of 13 μm. Drop 60 at the shallower $D_o$ of 6 μm, however, shatters when ejected while drop 62 at the deeper $D_o$ of 9 μm remains intact. For a chamber depth $D_o$ of 9 μm, partial compact ink drops 66, 68 and 70 are ejected for orifice depths $D_o$ of 6 μm, 9 μm and 13 μm, with each drop 66, 68 and 70 becoming more and more heavily weighted to the satellite droplets until a distinct tail begins to form on drop 70. For a chamber depth $D_o$ of 13 μm, a partial clear mode ink drop 72 is ejected for an orifice depth $D_o$ of 6 μm and non-clear mode drops 74 and 76 are ejected for orifice depths $D_o$ of 9 μm and 13 μm.

FIGS. 10 and 11 show ink drop shapes for narrower ($W_r$=20 μm) and wider ($W_r$=32 μm) resistors 14, respectively. Ink drops are indicated by part numbers 78-94 in FIG. 10 and part numbers 96-112 in FIG. 11. Drop shapes 78-112 in FIGS. 10 and 11 are similar to those corresponding to a square ($W_r$=26 μm) resistor 14 in FIG. 9 with a tail on the main drop developing at somewhat shallower orifice depths $D_o$ for the narrower resistor 14 in FIG. 10 and at somewhat deeper orifice depths $D_o$ for the wider resistor 14 in FIG. 11.

Referring again to FIGS. 1-5, the close proximity of dual ink inlet channels 30 to chamber 32 and resistor 14 allows a greater volume of ink to reach chamber 32 and resistor 14 faster than in conventional clear mode printing architectures. It is desirable, therefore, to position inlet channels 30 as dose as possible to resistor 14, within a few microns for example, and that the volume of inlet channels 30 match the volume of the drop ejected through orifice 34. Referring specifically to FIG. 2, the area of orifice 34 should approximate the area of resistor 14 to help balance ink drop ejection with blowback. Blowback refers to the phenomenon in which ink tends to be pushed back out of inlet channels 30 away from firing chamber 32 upon actuation of resistor 14 to eject an ink drop through orifice 34. Also, and referring now also to FIGS. 3-5, the volume of inlet channels 30 should be sized appropriately to balance blowback with refill. A thicker/deeper beam 40 reduces blowback but increases drag, thus slowing refill. A thinner/shallower beam 40 reduces drag and speeds refill, but increases blowback. For a typical implementation of ejector structure 12, it is expected that a bridge thickness/depth 10-50 μm, usually about 15 μm, and an inlet volume 0.5-2.0 times the sum of the volume of orifice 34 and the volume of firing chamber 32 will inhibit excessive blowback while still allowing refill rates sufficient to support high speed clear mode printing.

This bridge type architecture for ejector structure 12, with dual inlet channels 30 positioned in dose proximity to firing resistor 14, significantly reduces the mechanical impact on resistor 14 of the ink refilling chamber 32—the incoming ink does not hit the resistor with as much force as in a conventional printhead architecture. Also, since the ink bubble is vented out through orifice 34 during each ejection, there is no collapsing bubble and, accordingly, no cavitation damage to resistor 14 caused by collapsing ink bubbles. Thermal modeling for a metal bridge 40 in the configuration shown in FIG. 2-5 indicates the steady state temperature in both the ink and the surrounding structure are lower than in a conventional thermal inkjet printhead structure with the same resistor turn-on energy of 1 μJ. It is believed that the lower temperature is achieved at least in part by the more effective convective cooling of the dual inlet channel, metal bridge structure. Each of these factors helps improve the reliability of the firing resistors and extend the useful life of the printhead.

As used in this document, one part formed "over" another part does not necessarily mean one part formed above the other part. A first part formed over a second part will mean the first part formed above, below and/or to the side of the second part depending on the orientation of the parts. Also, "over" includes a first part formed on a second part or formed above, below or to the side of the second part with one or more other parts in between the first part and the second part.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid ejector structure, comprising:
- a chamber;
- a bridge spanning at least part of the chamber;
- a channel through which fluid may enter the chamber;
- a fluid ejector element on the bridge;
- an outlet through which fluid may be ejected from the chamber at the urging of the fluid ejector element, the outlet disposed opposite the fluid ejector element across a depth of the chamber, wherein a volume of the channel is 0.5-2.0 times a sum of a volume of the outlet plus a volume of the chamber; and
- wherein the chamber, ejector element and outlet are configured with respect to one another such that substantially all of the fluid in the chamber is ejected through the outlet upon actuation of the ejector element.

2. The structure of claim 1, wherein a sum of the depth of the chamber plus a depth of the outlet approximates a height of a fluid bubble formed in the chamber upon actuation of the ejector element.

3. The structure of claim 1, wherein a depth of the bridge is 10-50 μm.

4. The structure of claim 1, wherein an area of the outlet approximates an area of the ejector element.

5. The structure of claim 1, wherein the channel is positioned within a few microns of the ejector element.

6. The structure of claim 1, wherein the channel comprises a pair of channels each extending along opposite sides of the bridge, the span of the bridge being defined by the extent of the channels.

7. A fluid ejector structure, comprising:
- an ejector element sub-structure;
- an orifice sub-structure on the ejector element sub-structure;
- a plurality of fluid ejection chambers formed in one or both of the ejector element sub-structure and the orifice sub-structure;
- the ejector element sub-structure having:
  - a plurality of bridges each spanning at least part of a chamber;
  - a plurality of fluid ejector elements each formed on a corresponding one of the bridges; and
  - a plurality of channels through which fluid may enter the chambers, each of two channels in the plurality of channels extending along opposite sides of a corresponding one of the bridges such that the span of the bridge is defined by the extent of the two channels;
- the orifice sub-structure having a plurality of orifices each positioned at a chamber adjacent to a corresponding one of the fluid ejector elements; and
- for each fluid ejector element and corresponding structures, a sum of a depth of the chamber plus a depth of the orifice approximates a height of a fluid bubble formed in the chamber upon actuation of the ejector element, and wherein for each fluid ejector element a combined volume of the channels is 0.5-2.0 times a sum of a volume of the orifice plus a volume of the chamber.

8. The structure of claim 7, wherein the ejector element sub-structure comprises:

a substrate having a plurality of passages therein through which fluid may pass to the channels;

a thin film stack over the substrate, the fluid ejector elements formed in the film stack and the channels extending through the film stack; and each bridge being exposed to a passage.

9. The structure of claim 8, wherein each bridge comprises a metal bridge and each metal bridge and corresponding pair of channels is formed in a metal bridge part that is supported on the substrate and surrounds the corresponding chamber.

10. The structure of claim 8, wherein each bridge comprises a metal bridge and each metal bridge is part of a metal strip on the substrate that extends through a center portion of at least one chamber such that an outboard part of each channel in a corresponding pair of channels is formed by the substrate and an inboard part of each channel in the corresponding pair of channels is formed by the metal strip.

11. The structure of claim 8, wherein each bridge is part of the substrate.

12. An inkjet printhead structure, comprising:

a chamber;

a bridge spanning at least part of a width of the chamber;

a pair of channels through which ink may enter the chamber, each channel extending along opposite sides of the bridge;

a thermal ejector element on the bridge, wherein the thermal ejector is positioned within a few microns of each of the pair of channels;

an orifice through which ink may be ejected from the chamber, the orifice disposed opposite the ejector element across the depth of the chamber;

wherein the chamber, the ejector element and the orifice are configured with respect to one another for ejecting compact ink drops and a combined volume of the pair of channels is 0.5-2.0 times a sum of a volume of the orifice plus a volume of the chamber.

13. The structure of claim 12, wherein the chamber, the ejector element and the orifice configured with respect to one another for ejecting compact ink drops includes a sum of the depth of the chamber plus a depth of the orifice approximating a height of a fluid bubble formed in the chamber upon actuation of the ejector element.

* * * * *